United States Patent [19]

Molins

[11] 3,933,159

[45] Jan. 20, 1976

[54] MANUFACTURE OF MOUTHPIECE CIGARETTES

[75] Inventor: Desmond Walter Molins, London, England

[73] Assignee: Molins Limited, England

[22] Filed: Mar. 26, 1974

[21] Appl. No.: 454,953

Related U.S. Application Data

[63] Continuation-in-part of Ser. No. 222,568, Feb. 1, 1972, abandoned.

[30] Foreign Application Priority Data

Feb. 9, 1971 United Kingdom ..... 4284/71

[52] U.S. Cl. ..... 131/94; 131/72

[51] Int. Cl.[2] ..... A24C 5/48; A24C 5/58

[58] Field of Search ..... 131/94, 67–69, 131/72

[56] References Cited

UNITED STATES PATENTS

| | | | |
|---|---|---|---|
| 3,094,128 | 6/1963 | Dearsley | 131/94 |
| 3,420,243 | 7/1969 | McArthur | 131/94 |
| 3,470,884 | 10/1969 | McArthur | 131/94 |
| 3,526,233 | 9/1970 | McArthur | 131/94 |

FOREIGN PATENTS OR APPLICATIONS

| | | | |
|---|---|---|---|
| 731,964 | 4/1966 | Canada | 131/94 |
| 6,495 | 1900 | United Kingdom | 131/69 |

*Primary Examiner*—Robert W. Michell
*Assistant Examiner*—V. Millin
*Attorney, Agent, or Firm*—Craig & Antonelli

[57] ABSTRACT

Using a hot melt adhesive on the strip of material uniting a mouthpiece to a cigarette, and hardening the adhesive while the strip is rolled around the assemblage by heat lost to a surface along which the assemblage is rolled. The rolling takes place between a rolling plate and a drum which is heated to reactivate the adhesive prior to rolling.

5 Claims, 2 Drawing Figures

Figures 1, 2:
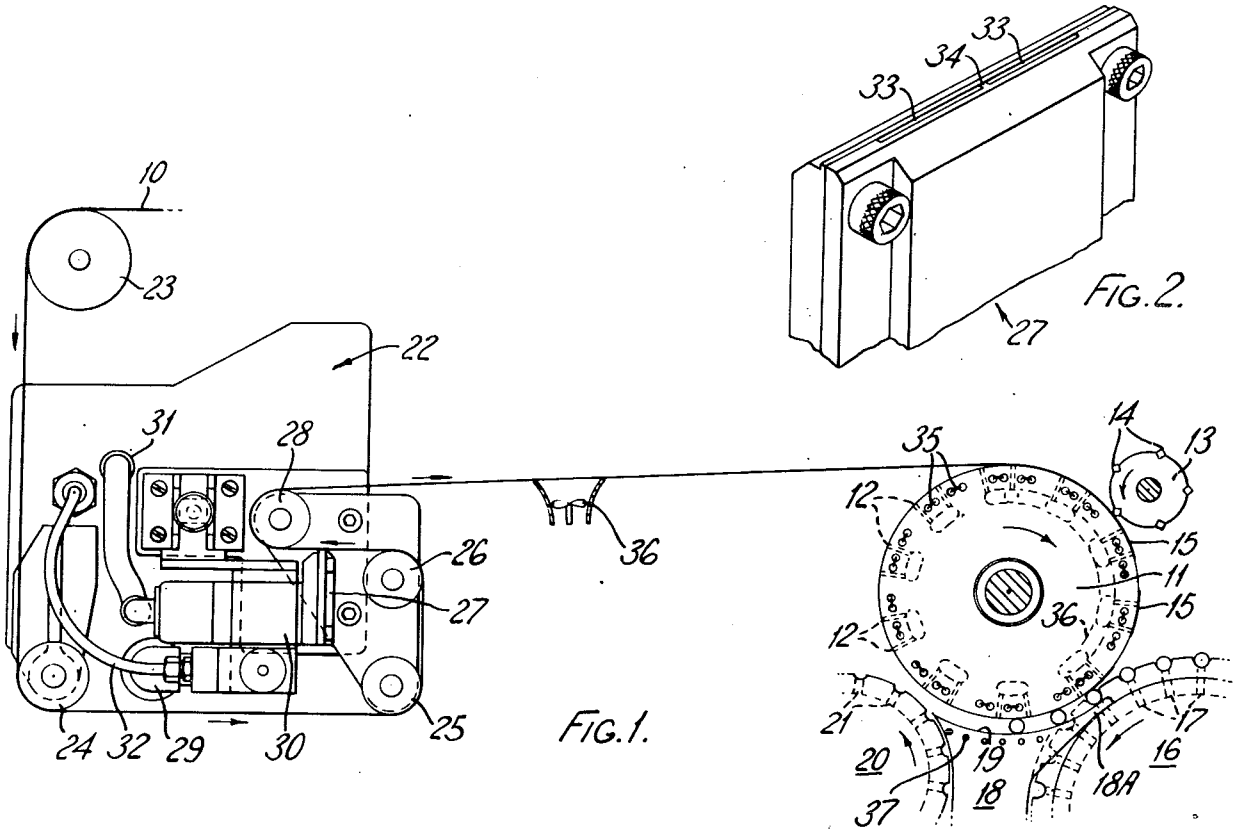

10
11
12
13
14
15
16
17
18
18A
19
20
21
22
23
24
25
26
27
28
29
30
31
32
33
34
35
36
37

MANUFACTURE OF MOUTHPIECE CIGARETTES

This application is a continuation-in-part of copending application Ser. No. 222,568 filed Feb. 1, 1972 now abandoned.

This invention relates to methods and apparatus for the manufacture of mouthpiece cigarettes in which a length of mouthpiece material e.g. a length of filter material, abuts a cigarette length, and is united thereto by an encircling band with an adhesive inner surface. The encircling band may be relatively narrow, or may be of sufficient width to not only effect the join but also extend to the full length of the mouthpiece portion.

Normally, in manufacture, two cigarettes are abutted against the opposite ends of a double length of mouthpiece material, and the resulting assemblage is severed through the middle to form two mouthpiece cigarettes. Two encircling bands may be used, one at each end of the double length of mouthpiece material, or a single encircling band of such width as to effect both joins, and to cover the double length of mouthpiece material may be used.

The encircling band may be united to the cigarette and mouthpiece by a rolling action, for example, between the outer surface of a drum and the inner surface of a rolling plate. However with such an arrangement trouble may be experienced if some of the adhesive gets on to a surface along which the assemblages are rolled and cannot be easily removed therefrom, particular difficulty being experienced with the removal of heat-curable adhesives, such as polyvinylacetate.

According to the present invention there is provided a method of making mouthpiece cigarettes by uniting a length of mouthpiece material to each cigarette in abutting relationship thereto by means of an encircling united band, which comprises applying molten hot melt adhesive to the uniting band material and, while the adhesive is sticky, rolling the encircling band around the abutting cigarette and mouthpiece portion along a surface the temperature of which is low enough to cool the adhesive to cause it to set.

The rolling may be carried out between two surfaces, one of which is heated to keep the adhesive molten before the rolling action, the encircling band being fed on to the heated surface and rolled around the cigarette and mouthpiece portion by the other surface which cools the adhesive.

Further according to the invention there is provided apparatus for making mouthpiece cigarettes by uniting a length of mouthpiece material to each cigarette in abutting relationship thereto by means of an encircling uniting band, comprising a rotatable drum, means to apply molten hot melt adhesive to a continuous web of uniting band material, means to deliver the web onto the drum at a temperature slightly below the melting point of the adhesive and at a speed less than the peripheral speed of the drum, severing means to sequentially cut off the successive foremost ends of the web on the drum to form a succession of uniting bands spaced apart by a gap, heating means to apply sufficient heat to the drum to re-activate the adhesive on the uniting bands, a rolling member having a concave part-cylindrical surface spaced from the drum to define a rolling passage therebetween, and conveyor means to directly deliver cigarette assemblages each with an aligned and abutted mouthpiece portion to said passage in timed relationship with the leading end of a re-activated uniting band so that said reactivated band is rolled in said passage around the preceding assemblage, the temperature of the rolling member being low enough to cool the adhesive to cause it to set.

Apparatus according to the present invention will now be described, by way of example, with reference to the accompanying drawings, of which:

FIG. 1 is a side elevation of part of apparatus for making mouthpiece cigarettes, and FIG. 2 is a perspective view of part of FIG. 1.

A continuous web of encircling band material 10 is fed from a reel, not shown, to a rotatable drum 11 which has suction ports 12 in its cylindrical surface, there being a stationary suction port 36 which communicates with the suction ports 12 commencing at the point where the web 10 meets the drum. The drum is rotated in a clockwise direction at such a speed that the peripheral speed of the cylindrical surface of the drum is somewhat greater than the rate of feed of the web. The web thus slips on the drum as it is fed to it. A rotor 13 which rotates in the counterclockwise direction has knife elements 14 which cooperate with the surface of the drum to cut off each successive foremost length of the web of uniting material to form a succession of uniting encircling bands 15. The bands or strips 15 are held to the surface of the drum by suction through the suction ports 12, and are spaced apart by a gap due to the difference in speeds between the continuous web 10 and the surface of the drum 11.

A fluted drum 16 rotates in the counterclockwise direction and carries in each of its flutes a pair of aligned cigarettes with a length of mouthpiece material therebetween. The mouthpiece material may be filter material and the lengths are double the length required for a single mouthpiece cigarette. The aligned cigarettes and lengths of mouthpiece material are abutted and are fed to the drum 16 by known means which may include further fluted drums. Suction is applied to the flutes of the drum 16 through ports 17.

A rolling member or plate 18 is provided below the drum 11 and has a part-cylindrical rolling surface 19 spaced from the surface of the drum 11 so as to form a rolling passage therebetween. Extending from the rolling member 18 are stripper fingers 18A which extend into circumferential channels in the drum 16 so as to remove from the flutes of the drum 16 the pairs of cigarettes with their associated lengths of mouthpiece material, suction being cut off from the flutes in the drum 16 to permit the transfer. The motion of the drum 11 causes the pairs of aligned cigarettes with the lengths of mouthpiece portions therebetween to be rolled through the rolling passage and then deposited in the flutes of a further fluted drum 20. Suction is applied through ports 21 to the flutes of this further drum.

The arrangement is such that each pair of cigarettes, with the length of mouthpiece portion therebetween, is fed into a gap between two strips 15 of uniting band and meets the leading end of the rear of the two strips 15 after meeting the drum 11, so that the rolling of the cigarettes and mouthpiece portions between the drum 11 and the rolling surface 19 causes the strip to be rolled around the assemblage so that adhesive on the inner surface of the strip unites the cigarettes and length of mouthpiece portion. United assemblages are thus transferred to the flutes of the drum 20 and are later severed through the middle of the double length mouthpiece portion in the normal manner to form two mouthpiece cigarettes.

The apparatus as so far described is similar to that shown in the single figure of U.S. Pat. No. 2,963,026 where the reel of encircling band material is shown at 3, the rolling drum at 1, the rotating knife arrangement at 5, and the member having a rolling surface 7 is shown at 6.

The strip of encircling band may be wide enough to effect the joins to both cigarettes, or a separate encircling band may be applied to each join. In the latter case a wide web of encircling band material may be cut into two narrow webs each of which is then severed as described above to form a succession of encircling bands.

The adhesive applied to the encircling band material 10 is a hot melt adhesive (i.e. an adhesive which is heated to become molten and sticky and is cooled to set the joint) and is applied by the applicator shown generally at 22. The continuous web of uniting band material 10 passes around rollers 23, 24, 25, and 26 and has the adhesive applied to it by a nozzle 27. The continuous web 10 then passes around a further roller 28 before proceeding to the drum 11. Hot melt adhesive is supplied under pressure to the unit through a pipe 29, and is heated in the heating chamber 30 to a temperature of about 150°C as it passes to the nozzle 27, the heater lead being shown at 31. Air pressure is applied through a pipe 32 to allow the hot melt adhesive to flow from the nozzle 27. The nozzle 27 is shown in more detail in FIG. 2. The adhesive is applied to the web 10 through two aligned slits 33 which are separated by a narrow web 34. Therefore, along the centre line of the web 10 no adhesive is applied, this being the place where the completed assemblage is eventually severed through to produce the two mouthpiece cigarettes. Thus, the hot melt adhesive is spaced from the extreme end of the mouthpiece of the cigarette which is placed in the smoker's lips.

A scraper (not shown) is provided to scrape any adhesive from off the drum 11.

Hot melt adhesives are hard and non-sticky at normal temperatures and are sticky when heated to the molten state. In the present apparatus the adhesive on the strips 15 is molten when the strip comes into contact with the cigarettes and mouthpiece portions from the drum 16 and is cooled and hardened as the strips are rolled around the assemblages.

It has been found that for the adhesive to be molten and tacky enough during the rolling operation it is too hot when the continuous web 10 is severed into the separate strips or bands 15 by the knives 14, so that tendrils of adhesive, like a floss, tend to form at the knives. To overcome this, it is arranged for the adhesive to be at a cooler temperature of about 60°C, that is slightly below the melting point of the adhesive when the web 10 is cut by the knives 14. This may be achieved by applying the adhesive to the continuous web 10 at a lower temperature, or by spacing the adhesive applicator further from the drum 11 so that the adhesive is cooler and harder when it reaches the knives 14, or by both such means. If necessary there can be provided additional means of cooling, such as a forced cooling airflow by means of a fan 36; or a cold member over which the web 10 runs before it reaches the drum 11. However, by reducing the temperature of the adhesive at the knives 14 the adhesive will be too cold for a good joint between the strip 15 and cigarettes and mouthpiece portion to be produced during the rolling action. The adhesive which has been cooled after application, so that the web can be severed without adhesive build-up on the knives 14, is therefore heated and re-activated by the drum 11 being heated by a heating element which passes in alternate directions through axial passages 35. Thus, the adhesive is hardened during the rolling by heat lost to the rolling member 18 only. The rolling member 18 may be cooled by having fins, and a flow of cooling air may be provided; or a cooling liquid could be passed through a series of passages 37 in the rolling member. If necessary, the member 18 could be refrigerated.

Whether the member 18 is cooled or not depends on a number of circumstances, such as: the design of the particular machine in which the invention is embodied, the ambient temperature conditions, and the choice of hot melt adhesives available.

With the drum 11 heated to about 90°C good bonds have been obtained with Eastabond M3 hot melt adhesives. Alternatively with Ecusta No. 2 hot melt adhesive a drum temperature of about 80°C has been found satisfactory.

What I claim as my invention and desire to secure by Letters Patent is:

1. Apparatus for making mouthpiece cigarettes by uniting a length of mouthpiece material to each cigarette in abutting relationship thereto by means of an encircling uniting band, comprising a rotatable drum, means to apply molten hot melt adhesive to a continuous web of uniting band material, means to deliver the web onto the drum at a temperature slightly below the melting point of the adhesive and at a speed less than the peripheral speed of the drum, severing means to sequentially cut off the successive foremost ends of the web on the drum to form a succession of uniting bands spaced apart by a gap, heating means to apply sufficient heat to the drum to re-activate the adhesive on the uniting bands, a rolling member having a concave part-cylindrical surface spaced from the drum to define a rolling passage therebetween, and conveyor means to directly deliver cigarette assemblages each with an aligned and abutted mouthpiece portion to said passage in timed relationship with the leading end of a re-activated uniting band so that said re-activated band is rolled in said passage around the preceding assemblage, the temperature of the rolling member being low enough to cool the adhesive to cause it to set.

2. Apparatus as claimed in claim 1 wherein the means to deliver the web comprises means to space the adhesive applying means such a distance upstream of the drum that the molten adhesive is cooled below its melting point by natural heat loss.

3. Apparatus as claimed in claim 2 further comprising fan means to apply a forced flow of cooling air to the adhesive.

4. Apparatus as claimed in claim 1 wherein the rolling member is maintained at said low temperature by means for passing cooling fluid therethrough.

5. Apparatus as claimed in claim 1 wherein the conveyor means delivers each assemblage into the gap between two reactivated uniting bands, so that the assemblage is initially in front of said leading end of a reactivated uniting band which is to be rolled therearound.

* * * * *